US005228215A

United States Patent [19]

Bayer

[11] Patent Number: 5,228,215

[45] Date of Patent: Jul. 20, 1993

[54] ANTI-SKID DISPOSABLE SHOECOVER

[76] Inventor: Robert T. Bayer, 42 Lakeview Rd., Asheville, N.C. 28804

[21] Appl. No.: 491,275

[22] Filed: Mar. 9, 1990

[51] Int. Cl.[5] ..... A43B 3/18

[52] U.S. Cl. ..... 36/7.7; 36/7.4; 36/9 R

[58] Field of Search ..... 36/7.1 R, 9 R, 9 A, 36/7.2, 7.5, 7.7

[56] References Cited

U.S. PATENT DOCUMENTS

| | | | |
|---|---|---|---|
| 1,980,486 | 11/1934 | King et al. | 36/4 X |
| 2,659,911 | 11/1953 | Spack | 12/142 G X |
| 3,793,748 | 2/1974 | Pursley | 36/9 R |
| 3,981,088 | 9/1976 | Mitchell et al. | 36/87 |
| 4,224,935 | 9/1980 | Niettelnick | 36/7.1 R X |
| 4,317,292 | 3/1982 | Melton | 36/9 R |
| 4,610,042 | 9/1982 | Theodorsen | 36/7.1 R X |
| 4,616,428 | 10/1986 | Leger | 36/9 R X |
| 4,825,564 | 5/1989 | Sorce | 36/9 R X |
| 4,897,935 | 2/1990 | Fel | 36/7.5 X |

FOREIGN PATENT DOCUMENTS

| | | | |
|---|---|---|---|
| 2619998 | 3/1989 | France | 36/7.1 R |
| 1156907 | 7/1969 | United Kingdom | 36/7.1 |
| 8705475 | 9/1987 | World Int. Prop. O. | 36/7.5 R |

*Primary Examiner*—Steven N. Meyers
*Assistant Examiner*—Beth Anne Cicconi
*Attorney, Agent, or Firm*—Carter and Schnedler

[57] ABSTRACT

There is provided an improved disposable shoecover which is particularly useful in medical environments. A strip of stretchable foam material on the bottom of the shoecover provides greatly improved anti-skid properties.

11 Claims, 2 Drawing Sheets

ANTI-SKID DISPOSABLE SHOECOVER

BACKGROUND OF THE INVENTION

This invention relates to disposable shoecovers. More particularly it relates to shoecovers for use by medical personnel or workers in clean rooms or those handling hazardous substances.

In hospital operating rooms and other places where surgical procedures are carried out, it is critical to maintain as sterile an environment as possible in order to prevent infections in the patient and healthcare workers. One area of particular concern in the operating room is the floor of the room. Operating room floors are designed with very smooth surfaces which helps reduce bacteria growth and accumulation of dirt, blood and other body fluids. The floor is usually washed with disinfectant after every procedure. Even though the floor is not considered a "sterile area," it can be a source of contamination. The floor can be contaminated by hospital workers walking into the room with personal shoes not being covered. Likewise hospital workers' shoes can be a transmitter of contamination to other departments of the hospital if they are not changed.

In order to overcome this problem, healthcare professionals have recommended the use of protective shoecovers, most of which are disposable. The shoecovers arc put on in an area adjacent the operating room.

Normally a shoecover is made of a spunbonded polypropylene or similar nonwoven material which impedes bacteria migration and other contamination. Thus a shoecover will protect the operating room and also will protect the user's shoes.

Because the operating room floor is kept so smooth and clean, and because of fluids on the floor, it has been found that users of the disposable shoecovers often slip on the floor. This slipping problem is not only a hazard for the wearer but also for the patient because the slipping may distract the operating room team while performing the surgical procedure.

There have been various attempts to solve the slipping problem associated with the disposable shoecovers. In some cases the bottoms of the shoecovers have been coated with a material which has a higher coefficient of friction than spunbonded polypropylene. Various patterns have been printed on the bottoms of the shoecovers for gripping the floor better.

U.S. Pat. No. 4,598,485 issued to Chun-Chuan Joe and Fa-Chang Joe shows a rubber rib glued in the seam which runs along the bottom of a shoecover. While it is believed that the purpose of the rubber rib is to enable the shoecover to be "one size fits all" it is possible that the rib may provide some anti-skid properties. While all of these constructions represent an improvement over a shoecover which is made purely of spunbonded polypropylene the problem of slipping remains and the cost of producing these modified shoecovers has increased.

OBJECTS OF THE INVENTION

It is therefore one object of this invention to provide an improved anti-skid disposable shoecover.

It is another object to provide a disposable shoecover which is inexpensive to manufacture and provides improved anti-skid properties.

It is another object to provide a disposable shoecover having improved anti-skid properties which is convenient to use and comfortable to wear.

SUMMARY OF THE INVENTION

In accordance with one form of this invention, there is provided a disposable shoecover made of a sheet of material covering the user's shoe. The material has opposing edges, parts of which are sealed together forming an inner cavity for receiving the user's shoe. The material has inner and outer surfaces. A stretchable foam is attached to a portion of the outer surface of the material in a region where the outer surface contacts the floor when the user's shoe is received in the inner cavity thereby providing improved anti-skid properties. The foam may also enable the cover to be of "one size fits all" construction.

Preferably the foam is a urethane in an elongated strip form which is applied slightly removed from the center of the bottom of the shoecover.

In another form of this invention, there is provided a method of manufacturing a disposable shoecover. A rectangular piece of material is folded longitudinally in half. A strip of elastomeric foam material is stretched and then adhered to a place on the material which is removed from the fold. Adjacent short edges of the material are sealed together. Portions of the adjacent long edges of the material are also sealed together and the portions of the adjacent long edges are left unsealed, thereby forming an enclosure having an opening therein.

Preferably a pair of elongated elastic strips are stretched and applied adjacent to portions of the long edges. The stretched foam and stretched elastic strips cause the shoecover to gather somewhat, thereby providing a snug fit and, to a degree, provides a one size fits all shoecover.

BRIEF DESCRIPTION OF THE DRAWINGS

The subject matter which is regarded as the invention is set forth in the appended claims. The invention itself, however, together with further objects and advantages thereof, may be better understood in reference to the accompanying drawings in which:

DESCRIPTION OF THE PREFERRED EMBODIMENTS

Figure 1:
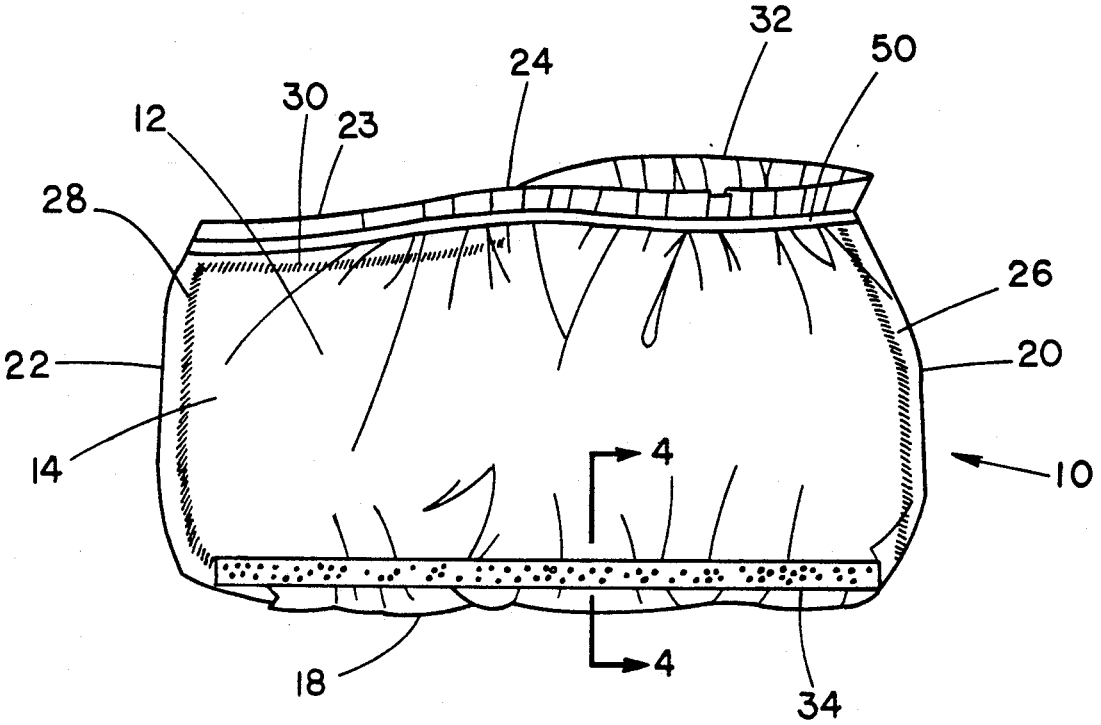
FIG. 1 is a side elevational view showing the disposable shoecover of the subject invention.

Referring now more particularly to FIGS. 1-5, there is provided disposable shoecover 10 which is particularly useful in operating rooms where surgical procedures are done. Shoecover 10 is primarily made of a lightweight commercially available material 12 such as spunbonded polypropylene which impedes the migration of bacteria. The shoecover could also be made of a liquid proof nonwoven fabric. The shoecover includes two adjacent panels 14 and 16 formed by fold 18 along the bottom of the shoecover resulting in a seamless bottom. Right end 20 and left end 22 are formed by sealing the respective short edges of the shoecover together. A portion of the length of the long edges are sealed together forming a closed part 23 of top 24. The seals are generally indicated as beads 26, 28, and 30. By leaving portion 32 unsealed, an opening 35 is provided in the top of the shoecover to permit entry of the shoe into the cover.

An elongated strip of stretchable foam 34 is adhered to panel 14 by hot melt adhesive. The strip 34 is applied to the panel 14 in its stretched condition. As can be seen from FIG. 4, strip 34 is made of a plurality of air filled cells 36. Preferably the strip is at least ½ inch wide and ⅛ inch thick to enhance the anti-skid characteristics. Further it is preferred that the strip extent substantially the entire length of the bottom of the shoecover. However a larger piece of foam could be attached to both panels 14 and 16 to cover the entire bottom 40 of the shoecover to further enhance user stability and anti-skid properties. Furthermore, a pair of strips could be provided, one on panel 14 and one on panel 16, in an identical fashion as shown on panel 14. Also, other designs for the foam material could be used such as, for example, sawtooth patterns as well as other patterns.

The preferable foam is a commercially available polyester urethane foam. One advantage of utilizing a polyester urethane foam is that it will not wick liquids which occur frequently in an operating room environment during a surgical procedure.

Figure 3:
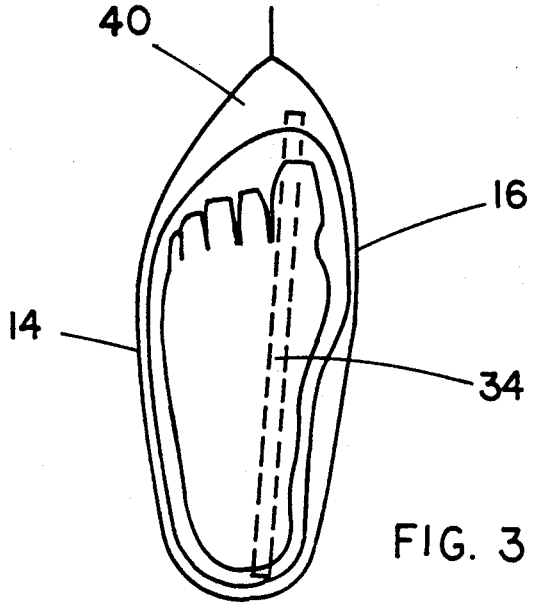
FIG. 3 is a top view of the disposable shoecover of FIG. 2 showing the outline of the user's shoe and foot and with the foam material represented as dotted lines.
Figure 4:
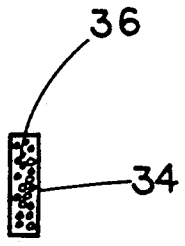
FIG. 4 is a sectional view of the foam strip shown in FIG. 1 taken through section lines 4—4.

As particularly illustrated in FIG. 3, the foam strip 34 is mounted to one side of the center of the bottom 40 of the shoecover. While the shoecovers are not constructed specifically for the right or left shoe, i.e. the strip will either be to the right or to the left of fold 18 for both shoecovers which are supplied to the user, the strip on one of the shoecovers of a pair may be placed directly under the places of the greatest downward force while being worn; that is, directly under the big toe, the ball of the foot and the heel of the wearer which may further enhance the anti-skid properties for one foot and thus enhance the stability of the wearer.

Figure 5:
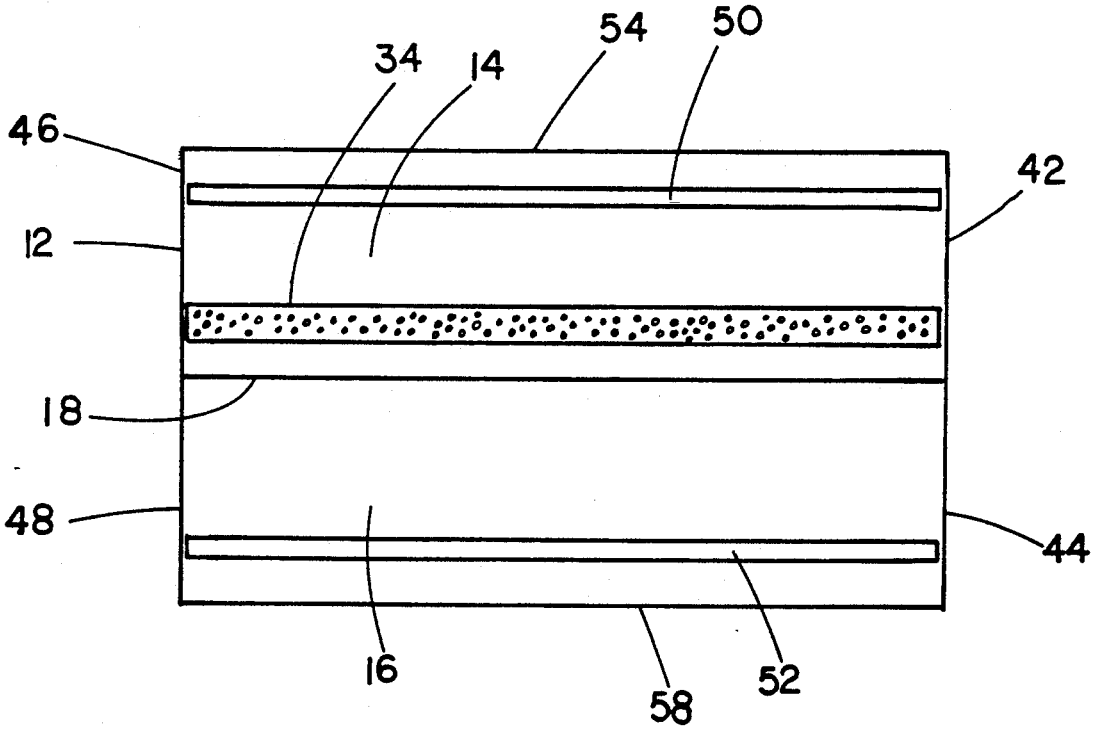
FIG. 5 is a side elevational view of the sheet of material and components used in the construction of the shoecover in FIG. 1, however with the left end being squared rather than rounded.

Referring now to FIG. 5, the disposable shoecover may be manufactured as described below. Rectangular shaped spunbonded polypropylene material 12 is folded exactly in half at fold 18 which will run along the bottom of the shoecover as shown in FIG. 1. This folding will result in short edges 42 and 44 being adjacent to one another and short edges 46 and 48 also being adjacent to one another. Polyester-urethane foam strip 34 is stretched and adhered to panel 14 slightly above fold 18. Hot melt adhesive is applied to strip 34. Strip 34 will run approximately along the entire length of the fold 18. It is preferred that the foam 34 not contact fold 18. Elastic strips 50 and 52 are placed juxtaposed to portions of long edges 54 and 58 which upon folding become adjacent to one another. These elastic strips are preferably made of rubber and are adhered to the panels 14 and 16 respectively by means of hot melt adhesive. After folding, short edge 42 is adhered to short edge 44 by ultrasonic sealing. Short edge 46 is adhered to short edge 48 again by ultrasonic sealing. A portion indicated by 23 in FIG. 2 of long edges 54 and 58 are adhered together also by ultrasonic sealing, thus forming opening 35 for the user to step into the shoecover.

Figure 2:
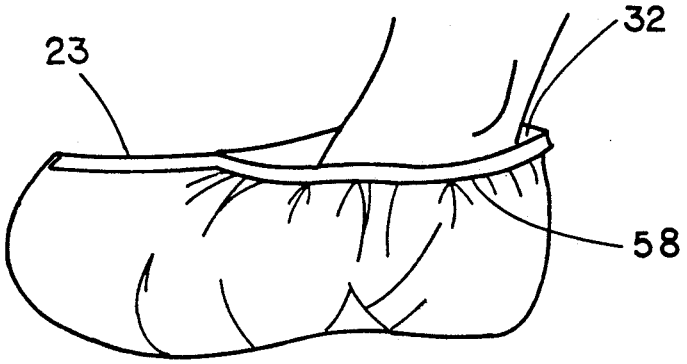
FIG. 2 is a pictorial view of the shoecover of FIG. 1 in use, however with the top long edges folded over.

As shown in FIG. 2, edges 54 and 58 may be folded over covering portion of elastic strips 50 and 52 to provide a better appearance for the shoecover. Portion 23 may be sealed slightly below its top edges thereby leaving a pair of small flaps which also may be folded over covering portions of elastic strips.

The shoecover of the subject invention described above has been tested and comparison tests have been conducted utilizing other shoecovers as set forth in Table A below.

TABLE A

The above tests were conducted using a Chatillon Tension Gauge. A weight of approximately one pound was applied to each sample. The numbers are the force in ounces required to overcome friction to begin moving the sample.

| SAMPLE | DRY SURFACE | WET SURFACE |
|---|---|---|
| 1. Control (Spunbonded Polypropylene, No anti-skid, No Elastic) | 2.1 | 2.3 |
| 1½ Oz. Spunbonded Polypropylene | | |
| 2. Subject Invention | 7.0 | 7.5 |
| 3. Elastic | 3.3 | 2.1 |
| Coated Tyvek | | |
| 4. Subject Invention | 10.1 | 9.5 |
| 5. Elastic | 5.4 | 6.6 |
| 6. French-Made Two Piece Design | 5.0 | 5.9 |
| 7. Swirl Tread Spunbond/Elastic | 3.1 | 4.0 |
| 8. Printed "S" Pattern-Spunbonded Polypropylene/Elastic | 4.9 | 4.1 |
| 9. Yellow Print Pattern-Spunbonded Polypropylene/Elastic | 5.5 | 5.6 |

NOTES:
1. "Elastic" refers to raw strip rubber.
2. Sample #6 made without elastic.
3. Sample #7 elastic sewn on inside (not exposed).
4. Sample #3 and #5 represent standard shoecovers, without anti-slip feature, but with elastic.

Thus an improved shoecover is provided which protects the wearer from liquid borne bacteria, protects the patient from bacteria present on the wearer's shoes, and also keeps the wearer's shoes clean and dry.

The shoecover of the subject invention is easier to manufacture than other so-called anti-skid shoecovers. The shoecover of the subject invention has better anti-skid properties than other shoecovers tested. The shoecover of the subject invention will be much more comfortable particularly as compared to the shoecover set forth in the Joe patent which utilizer a rubber strip attached to a seam. Furthermore, since the bottom of the shoecover is seamless the shoecover will inhibit liquid penetration.

From the foregoing description of the embodiments of the invention it will be apparent that many modifications may be made therein. It will be understood however that these embodiments of the invention are intended as examples of the invention only and that the invention is not limited thereto. It will be understood therefore that it is intended in the appended claims to cover all such modifications as fall within the true spirit and scope of the invention.

I claim:

1. A disposable shoecover for covering a user's shoe for use by hospital, surgical, or clean room personnel comprising:

a single sheet of nonwoven synthetic material for covering the user's shoe; said material having opposing edges; parts of said opposing edges are sealed together forming an inner cavity for receiving the user's shoe; said material having a inner and outer surfaces; stretchable foam attached to a portion of said outer surface of said material in a region where said portion of said outer surface contacts the floor when the user's shoe is received in said inner cavity thereby providing anti-skid properties; said portion of said outer surface which contacts the floor being seamless; said stretchable foam being in a relaxed unstretched condition when the user's shoe is not received in said inner cavity; said stretchable foam being in a stretched condition during attachment to said outer surface; said region where said portion of said outer surface contacts the floor having gathers formed therein at least when the user's shoe is not received in said inner cavity, whereby said shoecover will fit a plurality of shoe sizes.

2. A disposable shoecover as set forth in claim 1 wherein said foam is in the form of an elongated strip.

3. A disposable shoecover as set forth in claim 2 wherein said region where said portion of said outer surface contacts the floor includes an elongated seamless fold; said foam strip being adjacent to but not in contact with said fold.

4. A disposable shoecover as set forth in claim 1 wherein said foam includes an amount of urethane.

5. A disposable shoecover as set forth in claim 1 wherein said foam includes an amount of polyester.

6. A method of manufacturing a disposable shoecover comprising the steps of:

folding a rectangular piece of nonwoven synthetic material longitudinally in half; stretching a strip of elastomeric foam; adhering said stretched form a strip to said material adjacent to said fold; sealing adjacent short edges of said material together; sealing portions of adjacent long edges of said material together and leaving another portion of said adjacent long edges unsealed thereby forming an enclosure having an opening therein; permitting said stretched foam strip to relax thereby forming gathers in said nonwoven synthetic material.

7. A method as set forth in claim 7 further including the steps of:

stretching a pair of elongated elastic strips;

adhering said strips at least along opposite portions of said long edges.

8. A method as set forth in claim 7 wherein said foam includes urethane.

9. A method as set forth in claim 7 wherein said foam includes polyester.

10. A method as set forth in claim 7 wherein said nonwoven synthetic material is spunbonded polypropylene.

11. A disposable shoecover as set forth in claim 1 wherein said nonwoven synthetic material is spunbonded polypropylene.

* * * * *